US009810071B2

(12) United States Patent
Papple

(10) Patent No.: US 9,810,071 B2
(45) Date of Patent: Nov. 7, 2017

(54) INTERNALLY COOLED AIRFOIL

(71) Applicant: Pratt & Whitney Canada Corp., Longueuil (CA)

(72) Inventor: Michael Papple, Verdun (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 1093 days.

(21) Appl. No.: 14/039,181

(22) Filed: Sep. 27, 2013

(65) Prior Publication Data

US 2015/0093252 A1 Apr. 2, 2015

(51) Int. Cl.
*F01D 5/18* (2006.01)
*F01D 9/06* (2006.01)

(52) U.S. Cl.
CPC ..... *F01D 5/18* (2013.01); *F01D 9/065* (2013.01); *F01D 5/189* (2013.01); *F05D 2250/241* (2013.01); *F05D 2260/2212* (2013.01); *F05D 2260/22141* (2013.01)

(58) Field of Classification Search
CPC ..... F01D 5/187; F01D 5/188; F01D 5/189; F01D 5/18
USPC ..... 415/116, 117; 416/96 A, 96 R
See application file for complete search history.

(56) References Cited

U.S. PATENT DOCUMENTS

| | | | | |
|---|---|---|---|---|
| 4,257,734 | A * | 3/1981 | Guy | F01D 9/041 415/115 |
| 5,352,091 | A * | 10/1994 | Sylvestro | F01D 5/189 416/96 A |
| 6,290,462 | B1 * | 9/2001 | Ishiguro | F01D 5/187 416/97 R |
| 6,439,846 | B1 * | 8/2002 | Anderson | F01D 5/187 416/96 A |
| 7,163,373 | B2 | 1/2007 | Liang | |
| 7,544,044 | B1 * | 6/2009 | Liang | F01D 5/188 416/96 R |
| 8,360,725 | B2 * | 1/2013 | Anguisola McFeat | F01D 5/187 416/96 R |
| 2006/0171808 | A1 * | 8/2006 | Liang | F01D 5/18 416/97 R |
| 2010/0054915 | A1 | 3/2010 | Devore et al. | |
| 2010/0247284 | A1 * | 9/2010 | Gregg | F01D 5/189 415/1 |
| 2011/0027102 | A1 * | 2/2011 | Nakamata | F01D 5/186 416/97 R |
| 2012/0328450 | A1 * | 12/2012 | Spangler | F01D 5/187 416/97 R |

* cited by examiner

*Primary Examiner* — Richard Edgar
*Assistant Examiner* — Su Htay
(74) *Attorney, Agent, or Firm* — Norton Rose Fulbright Canada LLP

(57) ABSTRACT

An internally cooled airfoil for a gas turbine engine has a hollow airfoil body defining a core cavity. An insert is mounted in the core cavity. A cooling gap is provided between the insert and the hollow airfoil body. A plurality of standoffs project across the cooling gap. Trip-strips projecting laterally between adjacent standoffs. The trip-strips and the standoffs may be integrated into a unitary heat transfer feature.

18 Claims, 8 Drawing Sheets

INTERNALLY COOLED AIRFOIL

TECHNICAL FIELD

The application relates generally to gas turbine engines and, more particularly, to airfoil cooling.

BACKGROUND OF THE ART

Gas turbine engine design mainly focuses on efficiency, performance and reliability. Efficiency and performance both favour high combustions temperatures, which increase thermodynamic efficiency, specific thrust and maximum power output. Unfortunately, higher gas flow temperatures also increase thermal and mechanical loads, particularly on the turbine airfoils. This reduces service life and reliability, and increases operational costs associated with maintenance and repairs.

Therefore, there continues to be a need for new cooling schemes for turbine airfoils.

SUMMARY

In one aspect, there is provided an internally cooled airfoil for a gas turbine engine, comprising a hollow airfoil body defining a core cavity bounded by an internal surface, an insert mounted in the core cavity in spaced-apart relationship with said internal surface to define a cooling gap therewith, and a plurality of standoffs projecting from said internal surface into the cooling gap toward the insert, a plurality of trip-strips projecting from said internal surface of the hollow airfoil body, the trip-strips being intersperse between adjacent standoffs and extending laterally with respect thereto.

In a second aspect, there is provided an internally cooled turbine vane comprising a hollow airfoil body defining a core cavity, an insert mounted in the core cavity, a cooling gap between the insert and the hollow airfoil body, a plurality of standoffs projecting across the cooling gap, and trip-strips projecting laterally relative to the standoffs and only partway through the cooling gap.

DESCRIPTION OF THE DRAWINGS

Reference is now made to the accompanying figures, in which.

DETAILED DESCRIPTION OF THE PREFERRED EMBODIMENTS

Figure 1:
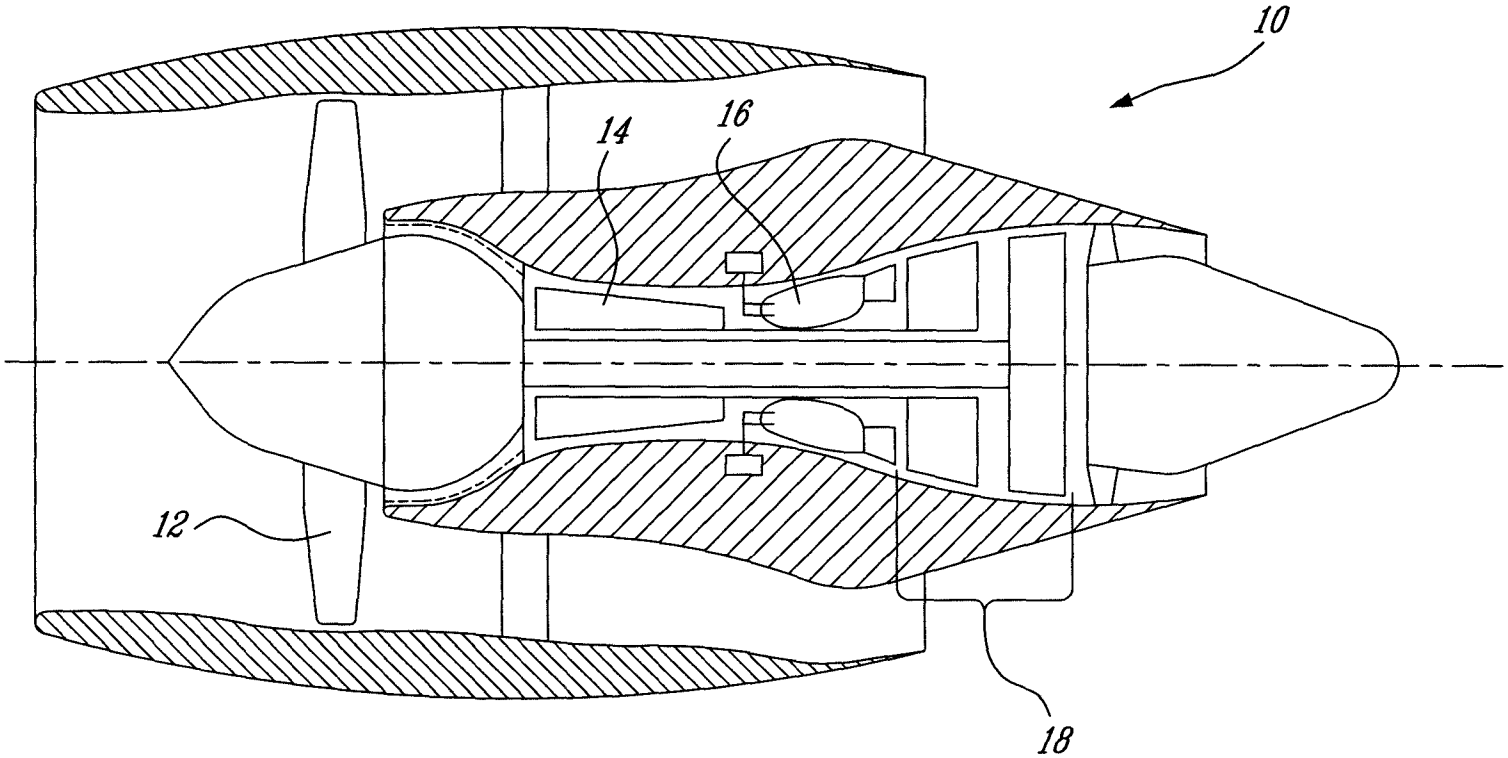
FIG. 1 is a schematic cross-sectional view of a turbofan gas turbine engine.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
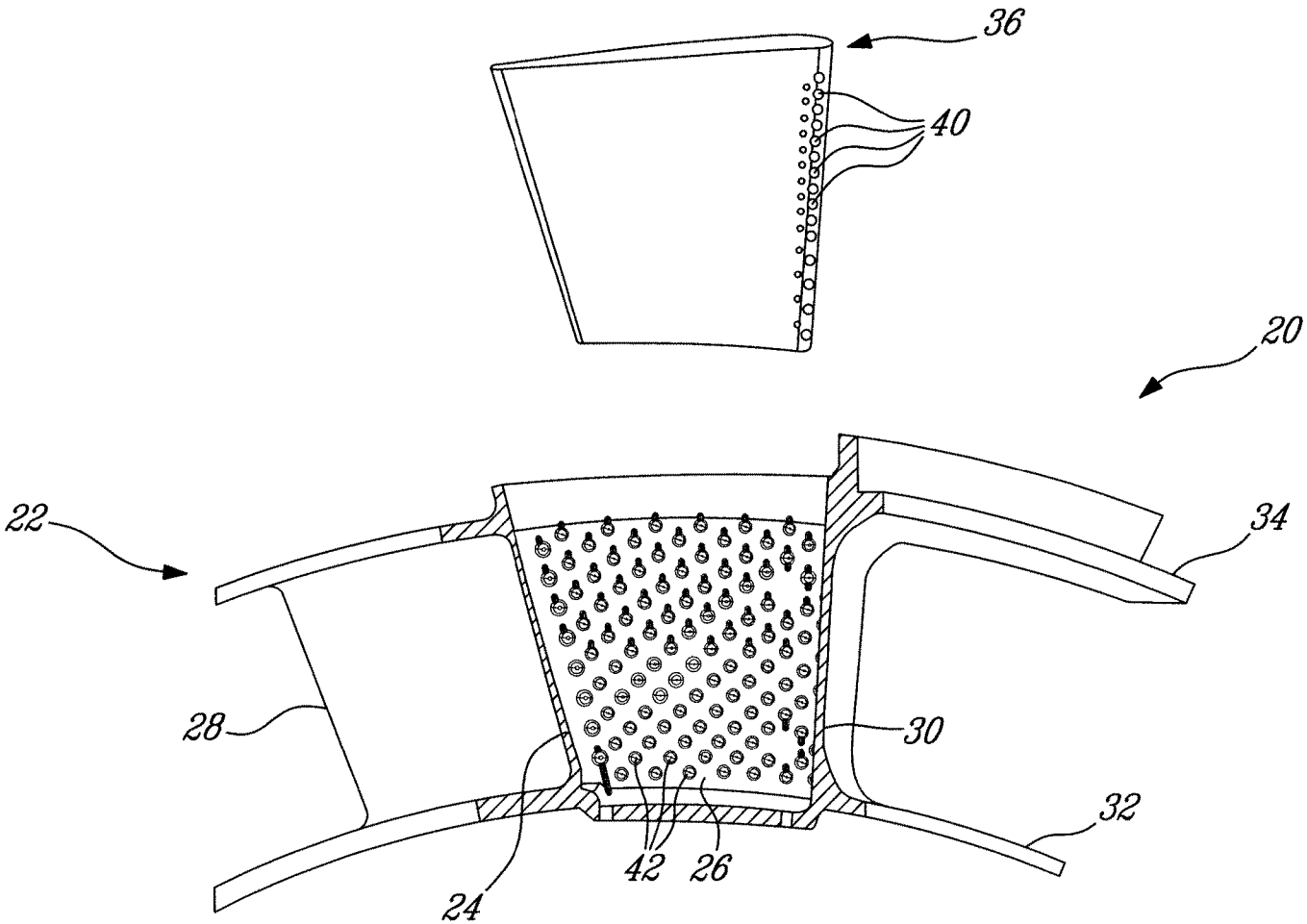
FIG. 2 is an exploded isometric view of an internally cooled turbine vane and associated insert with a portion of the concave pressure side wall of the vane removed to show the integration of trip-strips to standoffs on the airfoil core cavity surface of the hollow airfoil body of the vane.

The turbine section 18 may have various numbers of stages. Each stage comprises a row of circumferentially distributed stator vanes followed by a row of circumferentially distributed rotor blades. FIG. 2 illustrates a turbine vane 20 having an internal cooling structure in accordance with a first embodiment of the present invention. The turbine vane 20 has a hollow airfoil body 22 including a concave pressure side wall 24 and a convex suction side wall 26 extending chordwise from a leading edge 30 to a trailing edge 28. The hollow airfoil body 22 extends spanwise between inner and outer platforms 32 and 34. The hollow airfoil body 22 and the platforms 32, 34 may be integrally cast from a high temperature resistant material. The hollow airfoil body 22 has a core cavity 33 (FIG. 3) which is bounded by an internal surface 35 (FIG. 4) corresponding to the inwardly facing surface of the pressure and suction side walls 24, 26.

Figure 4:
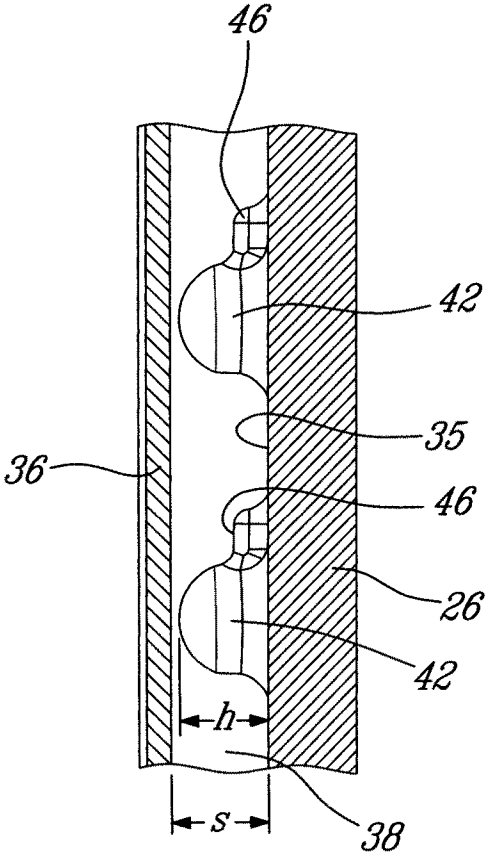
FIG. 4 is an enlarged view of portion A in FIG. 3.
Figure 3:
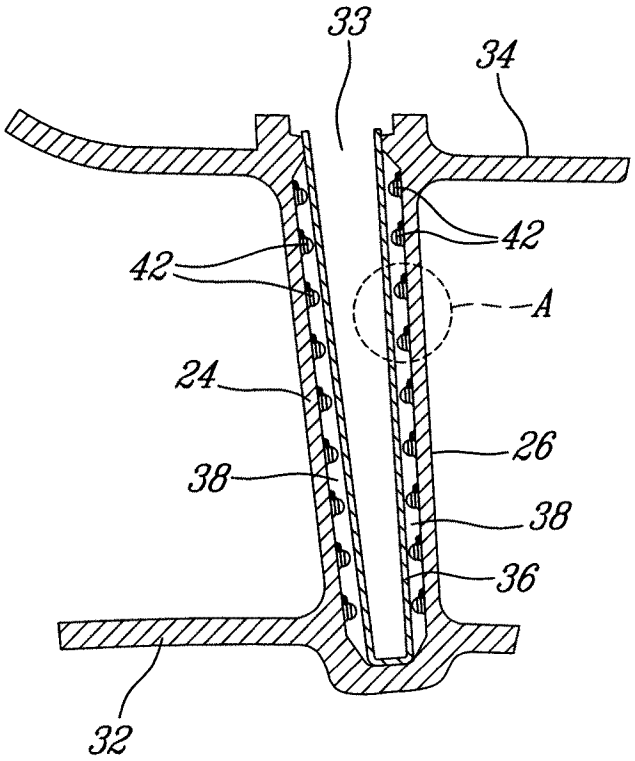
FIG. 3 is a cross-section view illustrating one row of standoffs integrated with strip-strips in a cooling gap between the insert and the internal surface of the hollow airfoil body.

Referring concurrently to FIGS. 2 to 4, an insert 36 is mounted in the core cavity 33 in spaced-apart relationship with the internal surface 35 to define a cooling gap 38 between the outer surface of the insert 36 and the internal surface 35 of the hollow airfoil body 22. The insert 36 may be provided in the form of a hollow sheet metal member. The insert 36 is connected to a source of coolant (e.g. compressor bleed air). Holes 40 are defined in the insert 36 for allowing coolant flowing therein to impinge upon the internal surface 35 of the hollow airfoil body 22.

As shown in FIGS. 2 to 5, a plurality of standoffs 42 project into the cooling gap 38. According to the illustrated embodiment, the standoffs 42 are provided in the form of cylindrical projections extending from the internal surface 35 of the hollow airfoil body 22 toward the insert 36. The standoffs 42 can be generally uniformly distributed over both the inner surface of the pressure and suction side walls 24, 26 of the hollow airfoil body so as to enhance heat transfer. As best shown in FIG. 4, the standoffs 42 have a height (h) which is set to be generally equal or slightly shorter than the spacing (s) between the internal surface 35 of the hollow airfoil body 22 and the external surface of the insert 36 to allow the insert to be assembled in the hollow airfoil body.

Figure 5:
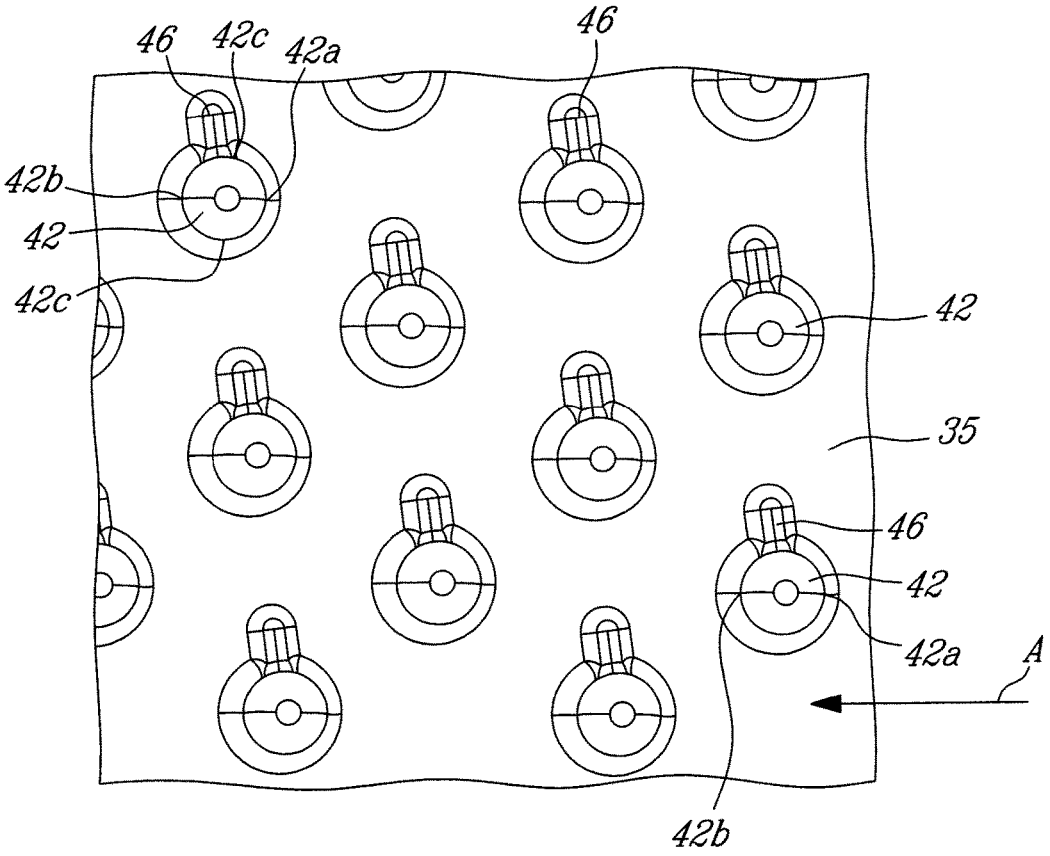
FIG. 5 is an enlarged plan view illustrating an example of the integration of the trip-strips to the standoffs on the internal surface of the hollow airfoil body.

Referring to FIGS. 4 and 5, it can be seen that trip-strips 46 project laterally from the standoffs 42 on the internal surface 35 of the hollow airfoil body 22. In other words, the standoffs 42 are provided at the base thereof with a trip-strip extension. As clearly shown in FIG. 4, the trip-strips 46 project into the cooling gap 38 by a distance less than the standoffs 42. The trip-strips 46 may be provided in the form of low profile ribs projecting a short distance into the cooling gap 38 to permit the coolant flow to pass thereover, thereby tripping the boundary layer of the coolant flowing in the cooling gap 38. The trip-strips 46 are oriented transversally to the flow direction (depicted by arrow A in FIG. 5) of the coolant in the cooling gap 38. According to one embodiment, the trip-strips are set at about 90 degrees to the flow direction. However, it is understood that other orientations are contemplated as well such as upstream, downstream or any angle from 0 to 360°.

The standoffs 42 and the trip-strips 46 may be integrally cast with the hollow airfoil body 22. The trip-strips 46 are integrated as wing-like extensions at the base of the standoffs 42. More specifically, the standoffs 42 have upstream and downstream sides 42*a*, 42*b* relative to the coolant flow direction and two lateral sides 42*c*, and the trip-strips 46 are positioned on at least one of the lateral sides 42*c*. According to an embodiment, the trip-strips 46 may all be provided on the same lateral side 42*c* of the standoffs 42 (i.e. the trip-strips may point in the same direction as shown in FIG. 5).

Figure 6:
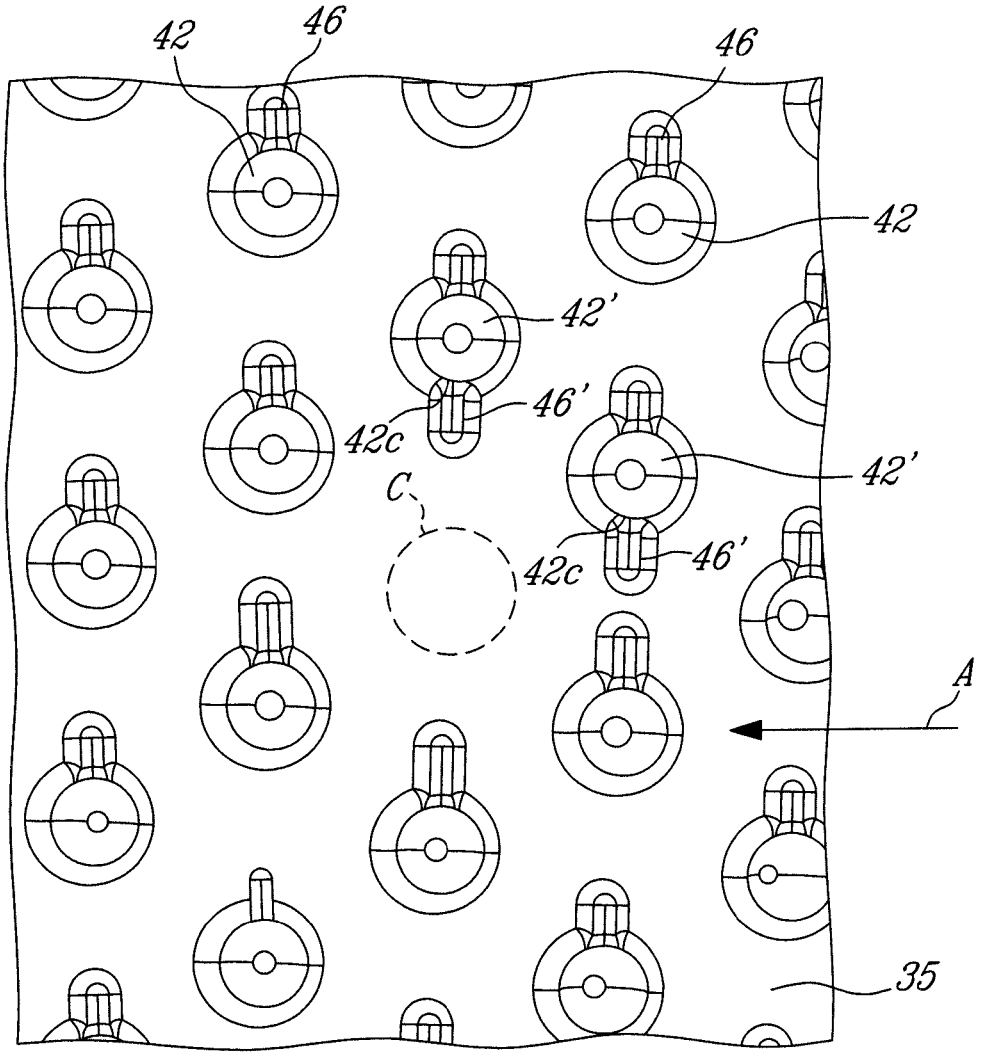
FIG. 6 is an enlarged plan view illustrating another example of trip-strips and standoffs integration on the internal surface of the hollow airfoil body.

FIG. 6 illustrates a first alternative implementation of combined standoff and trip-strip arrangement. According to this implementation, a standoff has been removed at location C to allow for sonic wall thickness inspection and extra trip-strips 46' have been added upstream of and beside the thickness inspection region C to locally improve heat transfer. As can be appreciated from FIG. 6, the extra trip-strips 46' extend from the lateral side 42*c* of standoffs 42' in a lateral direction opposite to that of the other trip-strips 46.

Figure 7:
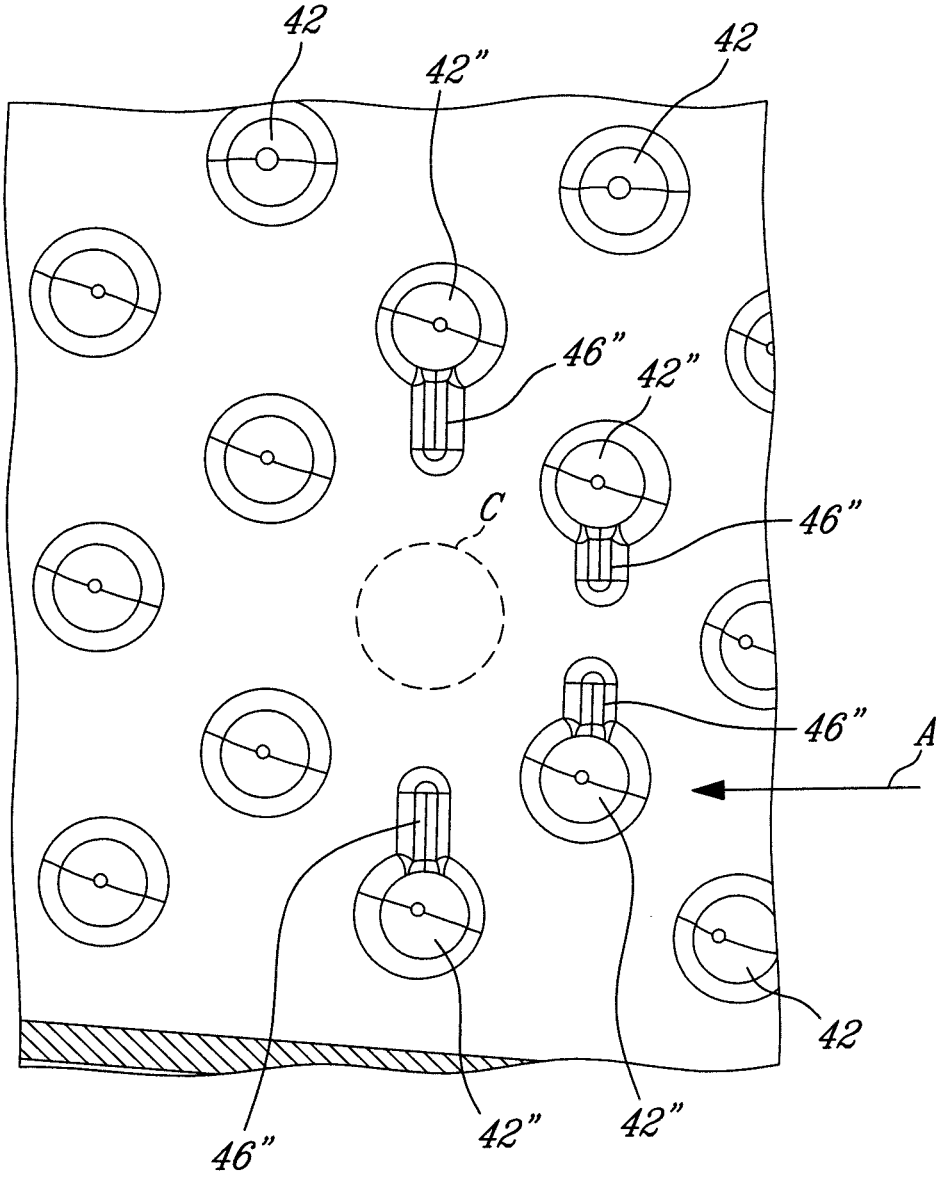
FIG. 7 is an enlarged plan view illustrating a further example of trip-strips and standoffs integration on the internal surface of the hollow airfoil body.

FIG. 7 illustrates another alternative wherein trip-strips 46" have only been added to the standoffs 42" disposed directly upstream of and beside the wall thickness inspection region C. According to this embodiment, standoffs 42 downstream from the inspection region C or not disposed immediately adjacent thereto are not provided with trip-strip portions.

Figure 8:
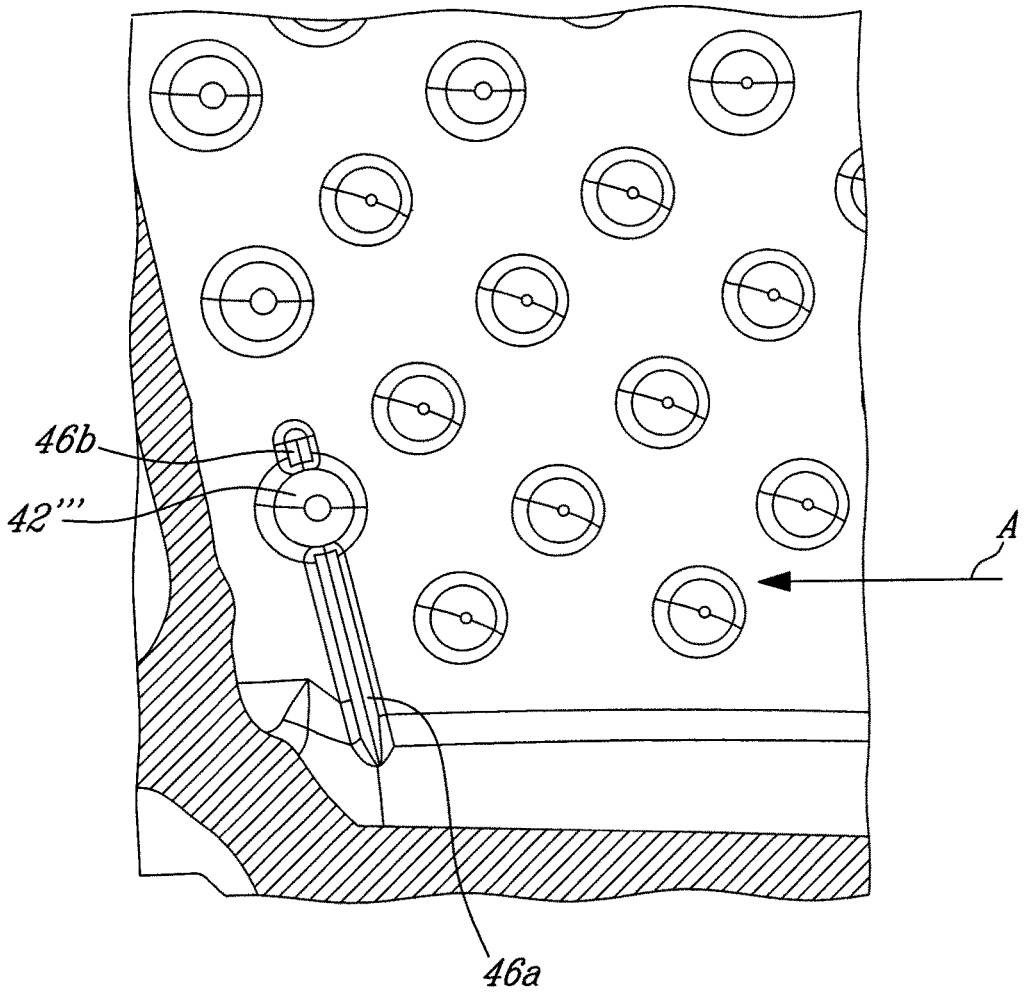
FIG. 8 is an enlarged plan view illustrating a still further example of trip-strips and standoffs integration on the internal surface of the hollow airfoil body.

FIG. 8 illustrates a further alternative in an enlarged plan view near the rear of the insert next to the inner platform 32, wherein long and short trip-strips 46*a*, 46*b* have been added on opposed lateral sides of a predetermined standoff 42'" to reduce coolant flow in an airfoil area downstream of the standoff 42'" relative to the coolant flow direction. Extending the trip-strip reduces the flow area from the trip-strip top to the insert. Reducing the cooling flow here diverts more coolant higher up on the airfoil where the temperature and heat load that the outside of the airfoil is exposed to is higher.

Figure 9:
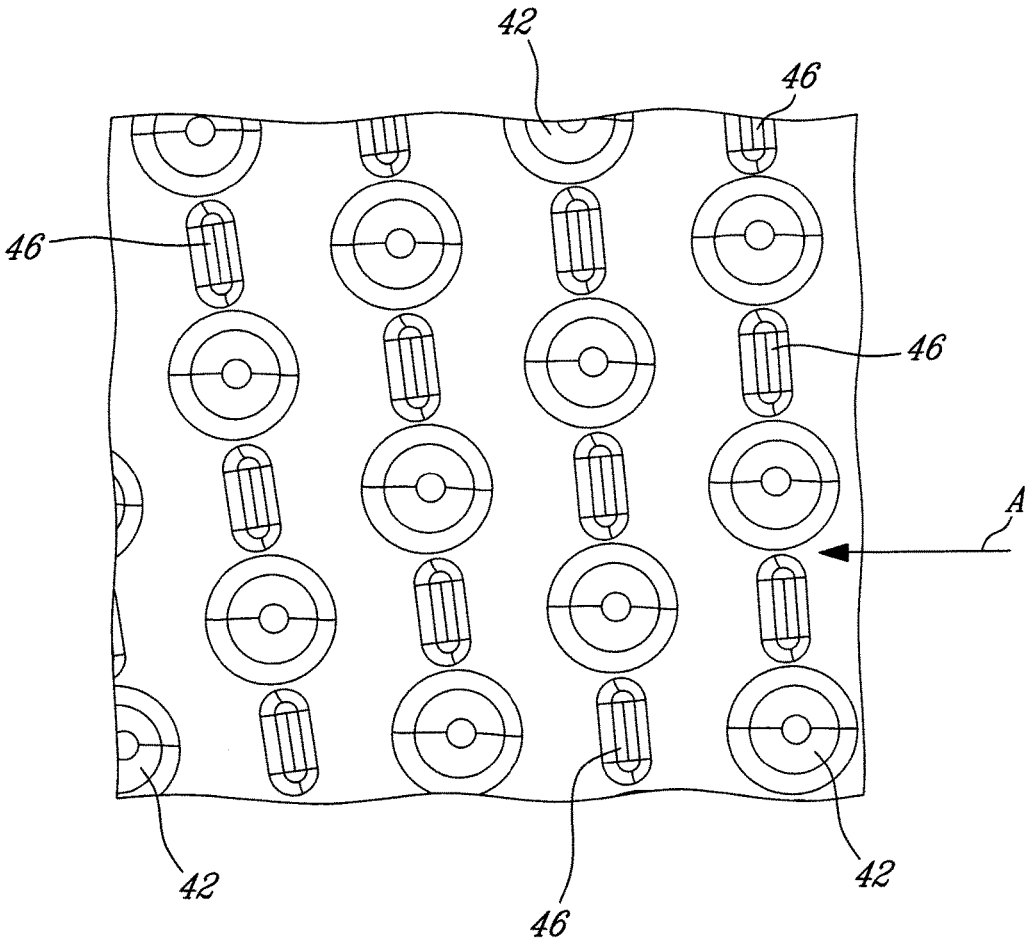
FIG. 9 is an enlarged plan view illustrating an alternative implementation in which trip-strips are located between standoffs in a direction transverse to the flow direction.

FIG. 9 is an enlarged plan view illustrating an alternative implementation in which trip-strips 46 are located between stand-offs 42 in a direction transverse to the flow direction. By making the trip-strips 46 shorter than the distance between standoffs 42, the heat transfer is increased without increasing the pressure loss excessively of the cooling air passing over and around the trip-strips 46 and standoffs 42.

As can be appreciated from the foregoing, the combination of standoffs and trip-strips contributes to enhance heat transfer while minimizing the coolant pressure drop across these heat exchange promoting features. By so improving the airfoil cooling efficiency, the thermal stress on the airfoil can be reduced and, thus, the service life of the airfoil can be extended. Also, by integrating the trip-strips to standoffs, the airfoil may be more easily cast than with conventional standoffs alone since a reduced number of integrated "standoff-trip" features can be used for the same heat transfer.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

What is claimed is:

1. An internally cooled airfoil for a gas turbine engine, comprising a hollow airfoil body including a pressure sidewall and a suction sidewall extending chordwise from a leading edge to a trailing edge, the pressure and suction sidewalls having an internal surface bounding a core cavity, an insert mounted in the core cavity in spaced-apart relationship with said internal surface to define a cooling gap therewith, and a plurality of standoffs projecting from said internal surface of said pressure and suction sidewalls into the cooling gap toward the insert, a plurality of trip-strips projecting from said internal surface of the pressure and suction sidewalls, the trip-strips being intersperse between adjacent standoffs and extending laterally with respect thereto, wherein the plurality of standoffs include standoffs in a mid-chord area of the pressure and suction sidewalls, the trip-strips intersecting the standoffs in the mid-chord area.

2. The internally cooled airfoil defined in claim 1, wherein at least one of the standoffs has a trip-strip integrated thereto as a lateral extension at a base of the at least one of the standoffs.

3. The internally cooled airfoil defined in claim 2, wherein each of said at least one of the standoffs has at least one trip-strip portion extending laterally from a side thereof, the at least one trip-strip portion being oriented transversally to a flow direction of coolant through the cooling gap.

4. The internally cooled airfoil defined in claim 3, wherein the at least one of the standoffs consist of cylindrical projections extending from the internal surface of the pressure and suction sidewalls, and wherein the at least one trip-strip portion is provided in the form of a wing-like projection extending from a base portion of a corresponding one of the cylindrical projections on said internal surface of the pressure and suction sidewalls.

5. The internally cooled airfoil defined in claim 1, wherein each of the plurality of standoffs have opposed upstream and downstream sides relative to a flow direction of coolant through the cooling gap, said opposed upstream and downstream sides being spaced by lateral sides, and wherein each of the plurality of trip-strips project from at least one of said lateral sides.

6. The internally cooled airfoil defined in claim 1, wherein the hollow airfoil body has a thickness inspection region on at least one of the pressure and the suction sidewall thereof, wherein said thickness inspection region corresponds to a standoff free region on said internal surface, and wherein the standoffs located immediately upstream of the standoff free region relative to a flow direction of coolant are provided with opposed facing trip-strip portions.

7. The internally cooled airfoil defined in claim 6, wherein the standoffs immediately adjacent to the standoff free region and disposed between upstream and downstream ends of the standoff free region relative to the flow direction of coolant are provided with trip-strip portions extending towards the standoff free region.

8. The internally cooled airfoil defined in claim 2, wherein said at least one of said standoffs has first and second trip-strip portions extending from opposed lateral sides thereof, said first trip-strip portion being shorter than said second trip-strip portion.

9. The internally cooled airfoil defined in claim 1, wherein the airfoil body is an airfoil casting and the insert is a sheet metal insert, and wherein the standoffs and the trip-strips integrally extend from the inner surface of the airfoil casting.

10. The internally cooled airfoil defined in claim 1, wherein the internally cooled airfoil is a turbine vane.

11. An internally cooled turbine vane comprising a hollow airfoil body defining a core cavity, an insert mounted in the core cavity, a cooling gap between the insert and pressure and suction sidewalls of the hollow airfoil body, a plurality of standoffs projecting across the cooling gap, and trip-strips projecting laterally between adjacent standoffs and only partway through the cooling gap between the insert and the pressure and suction sidewalls of the hollow airfoil body, the plurality of standoffs being distributed over an internal surface of the pressure and suction sidewalls, and including standoffs in a mid-chord area of the pressure and the suction sidewalls, the trip-strips intersecting the standoffs in the mid-chord area.

12. The internally cooled turbine vane defined in claim 11, wherein the standoffs have at least one trip-strip extending laterally from a side thereof, the at least one trip-strip being oriented transversally to a flow direction of coolant through the cooling gap.

13. The internally cooled turbine vane defined in claim 11, wherein the standoffs consist of cylindrical projections extending from the internal surface of the pressure and suction sidewalls, and wherein the trip-strips are provided in the form of wing-like projections extending from a base portion of the cylindrical projections.

14. The internally cooled turbine vane defined in claim 11, wherein each of the plurality of standoffs have opposed upstream and downstream sides relative to a flow direction of coolant through the cooling gap, said opposed upstream and downstream sides being spaced by lateral sides, and wherein each of the plurality of trip-strips project from each of the at least one of said lateral sides.

15. The internally cooled turbine vane defined in claim 11, wherein the hollow airfoil body has a thickness inspection region on at least one of the pressure and the suction sidewall thereof, wherein said thickness inspection region corresponds to a standoff free region on an inwardly facing surface of said at least one of the pressure and suction sidewalls, and wherein the standoffs located immediately upstream of the standoff free region relative to a flow direction of coolant are provided with opposed facing trip-strips.

16. The internally cooled turbine vane defined in claim 15, wherein the standoffs immediately adjacent to the standoff free region and disposed between upstream and downstream ends of the standoff free region relative to the flow direction of coolant are provided with trip-strips extending towards the standoff free region.

17. The internally cooled turbine vane defined in claim 11, wherein at least one of said standoffs has first and second trip-strips extending from opposed lateral sides thereof, said first trip-strip being shorter than said second trip-strip.

18. The internally cooled turbine vane defined in claim 11, wherein the airfoil body is an airfoil casting and the insert is a sheet metal insert, and wherein the standoffs and the trip-strips integrally extend from the inner surface of the airfoil casting.

* * * * *